United States Patent [19]

Kausen

[11] 3,950,061

[45] Apr. 13, 1976

[54] SOCKET FOR WEDGE BASE LAMP

[75] Inventor: Theodore Kausen, Fort Lee, N.J.

[73] Assignee: Industrial Devices, Inc., Edgewater, N.J.

[22] Filed: Dec. 20, 1974

[21] Appl. No.: 534,740

[52] U.S. Cl. ..... 339/93 L; 339/176 L
[51] Int. Cl.[2] ..... H01R 33/12
[58] Field of Search..... 339/75 R, 75 T, 59 L, 93 L, 339/176 L

[56] References Cited

UNITED STATES PATENTS

| | | | |
|---|---|---|---|
| 2,635,131 | 4/1953 | Greatbatch | 339/75 T |
| 3,200,363 | 8/1965 | Morgan | 339/93 L |
| 3,283,286 | 11/1966 | Webb | 339/59 L |
| 3,324,450 | 6/1967 | Winyard | 339/59 L |
| 3,648,044 | 5/1972 | Barnard | 339/59 L |
| 3,671,923 | 6/1972 | Rieth | 339/93 L |
| 3,676,834 | 7/1972 | Kaldor | 339/93 L |
| 3,783,437 | 1/1974 | Graff | 339/176 L |

*Primary Examiner*—Roy Lake
*Assistant Examiner*—Mark S. Bicks
*Attorney, Agent, or Firm*—Ryder, McAulay, Fields Fisher & Goldstein

[57] ABSTRACT

A socket for a wedge base lamp of the type having leads on opposed walls of the base and a cylindrical envelope is provided. The socket comprises a receptacle having an open top through which the lamp is inserted. A pair of terminals are positioned in the opening for respectively engaging each lead and a recessed seat is provided which engages the enlarged cylindrical envelope to limit downward movement of the lamp into the socket. A pair of opposed flexible and resilient ribs engage the cylindrical envelope. This construction maintains the lamp in a desired orientation.

13 Claims, 7 Drawing Figures

SOCKET FOR WEDGE BASE LAMP

This invention relates generally to lamp sockets for miniature lamps and, more particularly, pertains to a lamp socket which maintains in position a wedge base lamp.

The use of miniature lamps is expanding at a tremendous rate in such fields as the automotive and aircraft industries. In addition, such lamps are finding widespread use in electronic apparatus and in indicating equipment. Such miniature lamps have been found particularly advantageous because they take up relatively little space and, in most case, the filament is located in the same position relative to the base when a lamp is replaced. One such lamp presently gaining such widespread use is a so-called wedge base lamp such as, for example, the T-1½ Sub-Miniature Wedge Base Lamp No. GE-74, manufactured by General Electric Co. and described in the Sub-Miniature Wedge Base Lamp Bulletin 3-0326. However, problems have been encountered in providing a socket for such lamps.

To be more specific, sockets which are presently available for such lamps permit sufficient movement of the lamp within the socket so that electrical contact is broken between the lamp and the socket terminal. Additionally, present socket configurations dictate that the primary electrical contact within the socket occupy only a relatively small area. However, in practice, it has been found that the lamp lead shifts beyond the primary contact and therefore fails to complete a circuit with the contact.

Accordingly, an object of the present invention is to provide an improved lamp socket for a wedge base lamp.

A more specific object of this aspect of the invention is the provision of a lamp socket that firmly grips a wedge base lamp to prevent movement of the lamp within the socket.

Another object of the present invention resides in the novel details of construction that provide a lamp socket of the type described for a wedge base lamp that ensures electrical contact between the lamp leads and the socket terminal regardless of any shifting of the lamp lead.

Accordingly, a lamp socket constructed according to the present invention is specifically adapted for use with wedge base lamps of the type having leads on opposed sides of the wedge base and a cylindrical envelope. The socket comprises a receptacle having a lamp opening and a pair of terminals are positioned in said receptacle and are accessable through the opening for respectively engaging each one of the lamp leads in an electrical contact. Means in the receptacle limits the insertion of the lamp into the receptacle and stabilizing means is provided in the receptacle for engaging the lamp to maintain the lamp in a desired orientation to eliminate movement of the lamp.

In many instances, a lamp may become jammed in the lamp socket. Thus, a feature of the present invention is the provision of a socket for a wedge base lamp wherein the lamp may easily be inserted or removed.

Othere features and advantages of the present invention will become more apparent from a consideration of the following detailed description when taken in conjunction with the accompanying drawing, in which:

FIGS. 1A and 1B respectively illustrate a front elevational view and a side elevational view of a wedge base sub-miniature lamp to a greatly enlarged scale;

Figure 1A:
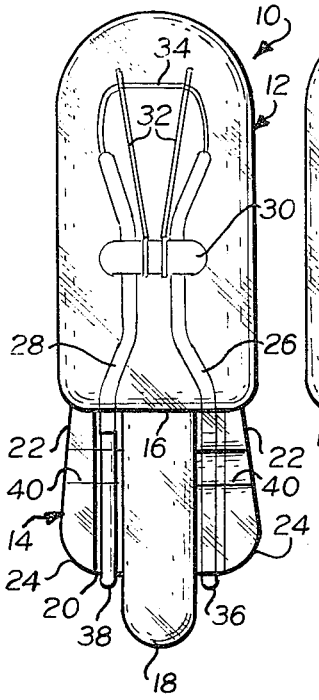

As noted hereinabove, the lamp socket of the present invention is designed for use with a so-called wedge base lamp. One such lamp is designated generally by the reference character 10 in the FIGS. and is of the type manufactured by the General Electric Co., as noted hereinabove. As shown in the figures, the lamp 10 comprises an upper cylindrical envelope 12 and a wedge base 14. More specifically, the base 14 is rectangular in cross-section and is of smaller width than the diameter of the cylindrical envelope 12 to form a shelf 16 therewith on each side of the base. An exhaust tip 18 extends below the lower edge 20 of the base and is formed when air is exhausted from within the lamp and the tip is sealed, it being understood that the lamp is fabricated from glass. The side edges 22 of the base 14 taper downwardly and outwardly to provide the wedge shape of the base. The lower portions of the side edges 22 are curved at 24 to facilitate insertion of the lamp into a socket.

Figure 1B:
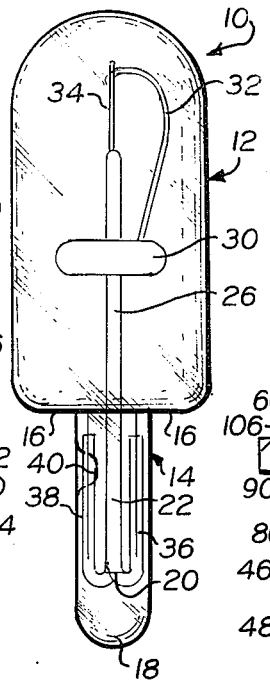

Received within the lamp are conductors 26 and 28 which extend through the base in sealing engagement therewith and terminate within the envelope 12. An insulating bead 30 extends between the conductors 26 and 28 and maintains the conductors in spaced relationship to each other. Extending upwardly from the bead 30 are spaced supports 32 which support, at their upper ends, a filament 34 that extends between the conductors 26 and 28 and is electrically connected thereto. The lower portions 36 and 38 of the respective conductors 26 and 28 extend outwardly below the bottom edge 20 of the base 14 and are bent back on opposite sides of the base to provide lamp leads, as shown in FIGS. 1A and 1B. That is, the lead 36 is positioned on one side of the base 14 and the lead 38 is positioned on the other side of the base 14. Rectangular recesses 40 are provided on those surfaces of the base opposite to the surface on which a lead lies. For example, as shown in FIG. 1A, the lead 36 lies on one surface of the base and the recess 40 is provided on the opposite surface in alignment with lead. Similar comments apply for the surface of the base opposite the lead 38. The lamp is energized by connecting the leads 36 and 38 to a source of energy.

In actual practice, the particular sub-miniature lamp identified above has an overall height of 0.8 inch and a maximum diameter of 0.240 inch. Since the leads 36 and 38 are simply bent back on the wedge base of the lamp, the leads can shift and, as a result, electrical contact between the lamp leads and the socket terminals can be broken. Additionally, because of the small size of the lamp, movement of the lamp within the socket also causes the electrical contact to be broken.

However, the socket of the present invention eliminates such problems.

Figure 2:
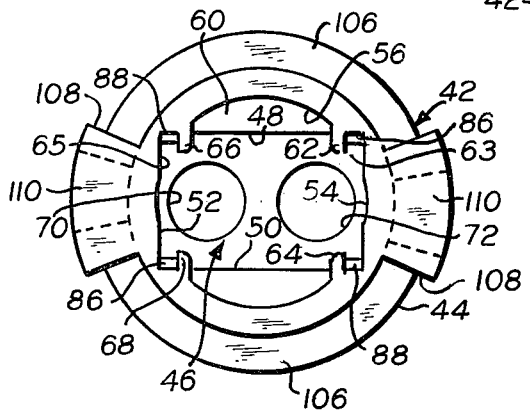
FIG. 2 is a top plan view of wedge base lamp socket constructed according to the present invention.

More particularly, a socket constructed according to the present invention is designated generally by the reference character 42 in the figures and comprises a receptacle 44. Provided in the receptacle 44 is a rectangular slot 46 defined by side walls 48 and 50 and end walls 62 and 54 (FIG. 2). Provided in the upper portion of the receptacle 44 and communicating with the slot 48 is a bore 46 having a larger diameter than the width of the slot so that a shelf or a seat 60 is defined by the junction of the bore and the slot. The bore 56 extends to the top of the receptacle to provide a lamp opening 58. Extending inwardly from the wall defining the bore 56 and downwardly along the bore wall and the walls 48 and 50 are opposed inwardly extending ribs 62 and 64 which are positioned adjacent the end wall 54 and in spaced relationship thereto to define a channel shaped groove 63 therewith. Similarly, a pair of opposed ribs 66 and 68 extend from the top of the receptacle 44 along the wall defining the bore 56 and the walls 48 and 50 of the slot 46 and are positioned adjacent the end wall 52 in spaced relationship thereto to define a channel shaped groove 65 therewith. Provided in the bottom wall of the slot 46 are through bores 70 and 72 through which leads 74 extend and are connected to lamp engaging terminals to connect the terminals with a source of power, as noted in greater detail below. The socket 42 is fabricated from a flexible and resilient material such as nylon or the like for reasons which will become apparent from a consideration of the disclosure below.

Figure 5:
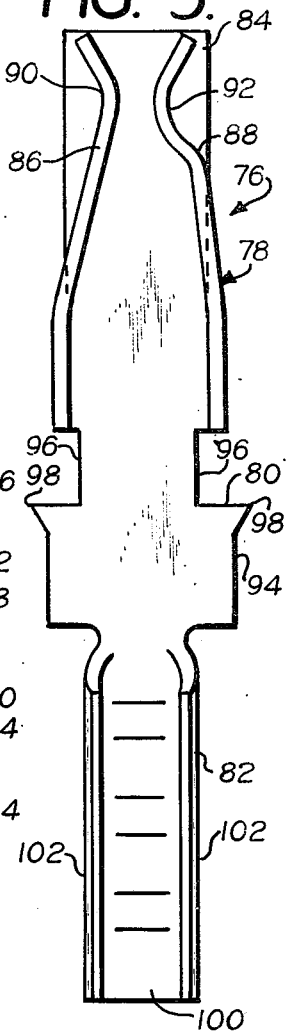
FIG. 5 is a front elevational view of a terminal utilized in the lamp socket construction of the present invention.

To be more specific, two identical terminals are provided in the socket 42. Since the terminals are substantially identical in construction, only one terminal will be described in detail. Accordingly, as shown in FIG. 5, the terminal 76 is fabricated from a spring metal such as brass having a spring temper and comprises an upper lamp connecting or engaging portion 78, an intermediate receptacle engaging portion 80, and a lower lead engaging portion 82. The upper lamp engaging portion 78 includes a rear wall 84 and opposed side walls 86 and 88. Approximately the lower third of the side walls 86 and 88 are connected to the rear wall 84. In practice, the walls 86 and 88 are formed from the same blank as the wall 84 by providing a pair of spaced slits along the blank and then folding the outer portions at a 90° angle to the intermediate portions thereby forming the rear wall and the opposed side walls. The upper portions of the walls 86 and 88 taper inwardly toward each other. The wall 86 is provided with a sharp reverse bend 90 adjacent the upper end thereof which makes an angle of approximately 30° with respect to the vertical. The wall 88 is provided with a detent 92 adjacent the upper end thereof opposite to the bend 90. Similarly, the upper end of the wall 88 tapers outwardly at an angle of approximately 30° with respect to the vertical.

The bend 90 and the detent 92 are positioned opposite each other and the space therebetween is slightly smaller than the width of the base 14 of the lamp 10. In other words, when the lamp base 14 is inserted between the walls 86 and 88, the walls will spread slightly so that the natural resiliency of the spring material will exert a biasing force against the base. The bend 90 is positioned to engage the lamp lead on the base and the detent 92 is sized and positioned to be received in the recess 40 on the opposite surface of the lamp base.

Hence, a pressurized electrical contact will exist between the terminal 76 and the lamp lead. Additionally, the reverse bends of the upper portions of the walls 86 and 88 provide a funnel to facilitate and guide insertion of the lamp base between the walls.

The receptacle engaging portion 80 of the terminal 76 comprises an enlarged substantially rectangular section 94 separated from the side walls 86 and 88 by notches 96. The side walls of the section 94 taper upwardly and outwardly adjacent the upper end of the section to form outwardly extending arms that form points 98 with the lower edges of the notches 96.

The lead engaging portion 82 of the terminal 76 comprises a downwardly extending rear wall 100 having curved side walls 102.

In assembling the socket 42, a lead 74 is placed on the rear wall 100 and the side walls 102 are crimped about the lead to ensure a good mechanical and electrical connection therebetween. However, this connection is for illustrative purposes only as any type of connection between the terminal and lead may be used as soldering the lead to the terminal. Thereafter, the lead 74 is inserted through the lamp opening 58 and through one of the bores such as the bore 72. The terminal is positioned so that the rear wall 84 is adjacent the end wall 54 of the rectangular slot 46 in the receptacle. The points 98 are positioned between the ribs 62 and 64 and the rear wall 54 of the slot 46.

Figure 4:
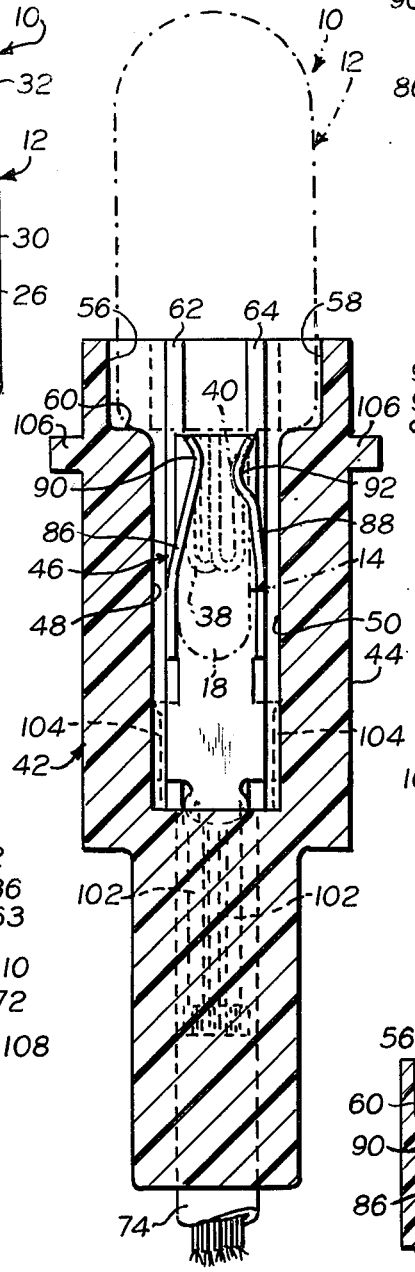
FIG. 4 is a vertical sectional view of the wedge base lamp socket.

As shown in FIG. 4, the walls 48 and 50 are provided with inwardly extending opposed projections 104 between the ribs 62 and 64 and the end wall 54 of the slot. The projections 104 extend for a height of approximately one-quarter of the overall height of the slot 46. As the lead 74 is pulled downwardly, the terminal 76 moves downwardly in the receptacle until the points 98, which have a width slightly in excess of the spacing between the projections 104, engage the projections. As additional slight downward pull on the lead 74 causes the points 98 to pierce the projections whereby the points are firmly embedded in the projections thereby affixing the terminal in place. It is to be understood that similar projections are provided between the ribs 66 and 68 and the rear wall 52 and the other terminal is affixed in place in the same manner. However, it will be noted that the side wall with the detent 92 therein on one terminal will be reversed with respect to the corresponding side wall of the other terminal. That is, since the recess 40 is on opposite sides of the wedge base of the lamp for each lead, the detents 92 on each terminal will similarly be on opposite legs. As shown in FIG. 4, the terminal 76 terminates slightly below the shelf 60.

Figure 3:
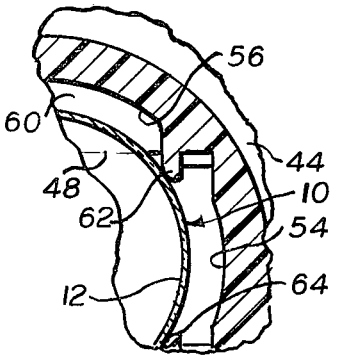
FIG. 3 is a detailed view of the socket shown in FIG. 2 illustrating the rib construction of the socket.

The socket 42 shown in FIGS. 2–4 is a so-called panel mounted socket and is adapted to be mounted through the rear surface of a panel so that only the forward portion of the socket projects through the panel. More particularly, the socket is provided with a pair of radially extending flanges 106 that are spaced below the top edge of the socket. Each flange extends for less than 180° about the circumference of the socket and terminates in a vertical wall 108 and a circumferentially extending ear 110 having a top surface that is coplanar with the top edge of the wall defining the bore 56 and which is spaced above the opposite flange 106. When mounting the socket, the panel is provided with a cutout substantially in the shape of the socket as shown in FIG. 2 with the exception that the diameter of the center cutout portion is smaller than the diameter across the socket including the flanges 106. Thus, when the socket is to be mounted, it is inserted through the panel cutout with the ears 110 projecting through the corresponding ear cutouts in the panel. However, since the diameter of the circular center portion of the cutout is smaller than the diameter across the flanges 106, the flanges 106 will abut the rear surface of the panel. Thereafter, the socket if rotated slightly until the cutout of the ear portion engages the vertical wall 108. The spacing between the flanges 106 and the lower surface of the ears 110 is substantially equal to the thickness of the panel so that the socket will remain in place.

As noted above, in accordance with the present invention, the socket is fabricated from a flexible and resilient material such as nylon. In other words, the socket is fabricated from a material such that it will flex slightly when the lamp is inserted into the socket and will attempt to regain its original shape thereby exerting a bias on the lamp. To be more specific, in operation, the wedge base 14 of the lamp is aligned with the rectangular slot 46 and is then pushed downwardly into the receptacle 44. Since the spacing between the side walls 86 and 88 of the terminals is smaller than the width of the base, the base will force apart these side walls. Since the terminals are fabricated from a spring material, they will exert a biasing force against the opposed surfaces of the wedge base. The lamp is pushed downwardly until the shelf 16 seats on the seat or shelf 60 to limit further downward movement of the lamp. Since the walls of the terminal terminte below the shelf 60, the cylindrical envelope of the lamp will be spaced above the terminals so that the larger portion of the lamp will be prevented from spreading the walls 86 and 88. As noted above, the terminals are sized and positioned so that the detent 92 in each terminal will engage the corresponding recess 40 in the wedge base 14 to prevent the lamp from accidently falling out of the socket. Additionally, the bend 90 of each terminal will firmly engage the lamp lead to provide a solid mechanical and electrical connection between the lamp and the terminal. A course of power may then be connected to the leads 74 to cause the lamp to be illuminated.

It is emphasized that the ribs 64–68 of the lamp socket firmly engage the cylindrical envelope 12 of the lamp as shown in FIG. 3 to prevent any rotation or movement of the lamp within the socket. That is, the distance between opposed ribs such as 62 and 64 is slightly smaller than a chord drawn through the cylindrical envelope of the lamp at those points. Accordingly, as the lamp is inserted into the socket, the lamp socket will flex slightly due to the fact that the lamp is slightly larger than the distance between the ribs. The resiliency of the socket will then exert a biasing force on the lamp to maintain the lamp in position.

Thus, the biasing forces exerted by the ribs on the lamp envelope act to prevent movement of the lamp in the socket. Therefore, these elements may be considered to be stabilizing means for maintaining the lamp in a desired orientation.

The funnel-shaped opening of the terminals facilitates insertion of the lamp base into the socket since the terminals correctly guide the base into place. Moreover, as has been noted above, the lead on the lamp may shift due to a number of reasons and, in fact, the lead may shift around to the side edges of the lamp base. However, in accordance with the present invention, the rear wall 84 of the terminals 76 will engage the lamp lead if the lead has shifted to the extent described so that the electrical connection will always be maintained with the lamp leads.

Figure 6:
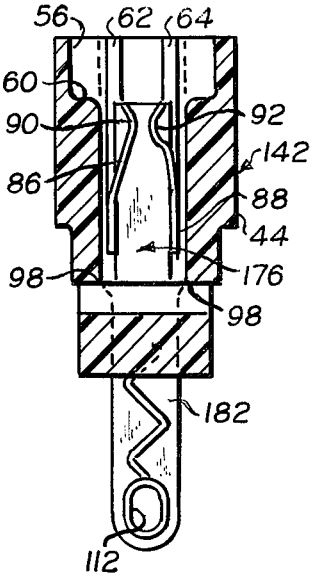
FIG. 6 is a vertical sectional view of a modified embodiment of a wedge base lamp socket, to a reduced scale.

A modified embodiment of the socket of the present invention is shown in FIG. 6 and is designated generally by the reference 142. Identical reference characters in the socket of FIG. 6 indicate corresponding elements with respect to the socket shown in FIGS. 2–4.

A comparison of the socket 142 of FIG. 6 with the socket shown in FIGS. 2–4 shows the sockets are substantially similar except that the socket of FIG. 6 is not adapted to be mounted in a panel. In other words, the socket of FIG. 6 is substantially smaller than the socket 42 and it is not provided with the flanges 106 and ears 110. Moreover, the socket of FIG. 6 includes a terminal 176 that is similar to the terminal 76 shown in FIG. 5 with the exception that the lead engaging portion 182 of the terminal 176 is straight rather than including curved side walls 102. Moreover, the lead engaging portion 182 extends below the bottom surface of the receptacle 44. Additionally, the portion 182 is provided with an aperture 112 through which an external lead may be threaded and soldered in place so that the lead is mechanically and electrically connected to the terminal. The socket 142 operates in the same manner as the socket 42 to maintain the wedge base lamp in position and to mechanically maintain and electrically connect the lamp to a source of energy.

Accordingly, a lamp socket for a wedge base lamp has been described which maintains sub-miniature lamps in electrical contact with the socket terminals and which prevents movement of the lamp within the socket and subsequent disconnection therebetween.

While preferred embodiments of the invention have been shown and described herein, it will become obvious that numerous ommissions, changes and additions may be made to such embodiments without departing from the spirit and scope of the present invention.

What is claimed is:

1. A lamp socket for a wedge-base lamp of the type having a pair of leads extending along the wedge-base, and a cylindrical envelope; said socket comprising:

a receptacle having a cylindrical wall of substantially circular cross-section defining a lamp opening;

said receptacle being of sufficient height to receive at least a portion of the lamp envelope therein;

a pair of terminals in said receptacle accessable through said opening for respectively engaging each one of said lamp leads to connect said leads to a source of energy;

and stabilizing means in said receptacle for engaging said lamp to prevent movement of said lamp with respect to said terminals;

said stabilizing means comprising at least a pair of opposed resilient ribs adapted to engage said envelope and extending upwardly on the inner surface of said wall a distance sufficient to engage the envelope in a line contact, said ribs being integral with said wall along their entire length and projecting inwardly toward each other a predetermined distance so that the space between said ribs is slightly smaller than the width of said envelope at the point where said ribs engage said envelope.

2. A lamp socket as in claim 1, in which said pair of terminals are provided with an upper lead-engaging portion, said upper portion comprising opposed flexible members adapted to grip said base therebetween in tight mechanical engagement, and a rear wall between said flexible members extending upwardly a sufficient distance to engage a lamp lead positioned at the edge of the base of the lamp.

3. A lamp socket as in claim 2, in which said receptacle further comprises a shelf extending inwardly from said wall to provide a seat engageable with the lamp envelope to limit downward movement of the lamp into said socket.

4. A lamp socket as in claim 3, in which said stabilizing means further comprises two pairs of ribs, each pair of ribs comprising opposed ribs on the inner surface of said wall extending toward each other from said inner surface and defining a space therebetween that is slightly smaller than the width of the envelope at the point of engagement of said ribs with said envelope.

5. A lamp socket as in claim 4, in which said receptacle is fabricated from a flexible and resilient material.

6. A lamp as in claim 5, in which said receptacle is facribed from nylon.

7. A lamp as in claim 5, in which said pair of terminals each comprise a member having an upper portion having oppose side walls and a co-extensive rear connecting wall, said side walls being flexible and resilient over a portion of their length and tapering upwardly and inwardly toward each other to define a space therebetween that is smaller than the width of said wedge base, an inwardly extending detent on one of said side walls positioned to be received in a corresponding recess in said wedge base, and an inwardly extending bend on the other of said side walls for engaging said lead.

8. A lamp socket as in claim 3, in which said pair of terminals terminate below said seat means.

9. A lamp socket as in claim 1, in which said pair of terminals each comprise a member having a channel shaped upper portion having opposed side walls and a co-extensive rear connecting wall, said side walls being flexible and resilient over a portion of their length and tapering upwardly and inwardly toward each other to define a space therebetween that is smaller than the width of said wedge base, whereby said walls grip said lead in an electrical contact, said upper portion comprising said stabilizing means.

10. A lamp socket as in claim 9, in which said wedge base is provided with recesses on opposed surfaces, and an inwardly extending detent on one of said terminal side walls engageable in said recess, and an inwardly extending bend on the other of said terminal side walls engageable with the lamp lead.

11. A lamp as in claim 9, wherein said terminal further comprises an intermediate portion having ears tapering outwardly and upwardly to a point, the distance between said points being slightly larger than the width of said opening adjacent said points. whereby said points engage said receptacle to prevent upward removal of said terminal.

12. A lamp as in claim 11, in which said terminal further comprises a connector portion adapted to be connected to a lead.

13. A lamp as in claim 9, in which said stabilizing means further comprises two pairs of ribs in said opening, each pair of ribs extending inwardly from said wall toward each other and defining a channel-shaped groove together with the portion of the wall therebetween defining said opening, said terminal being received in said groove.

* * * * *

UNITED STATES PATENT AND TRADEMARK OFFICE

CERTIFICATE OF CORRECTION

PATENT NO. : 3,950,061

DATED : April 13, 1976

INVENTOR(S) : Theodore Kausen

It is certified that error appears in the above-identified patent and that said Letters Patent are hereby corrected as shown below:

At Col. 1, line 19, change "T 1½" to --T 1¾--;
line 65, change "othere" to --other--.

At Col. 3, line 8, change "62" to --52--.

At Col. 5, line 8, change "if" to --is--.

At Col. 7, line 19 (claim 6), after "lamp" insert --socket--;
line 20 (claim 6), change "fabribed" to --fabricated--
line 21 (claim 7), after "lamp" insert --socket--.

At Col. 8, lines 17, 24 and 27, after "lamp" insert --socket--.

Signed and Sealed this

Tenth Day of August 1976

[SEAL]

*Attest:*

RUTH C. MASON
*Attesting Officer*

C. MARSHALL DANN
*Commissioner of Patents and Trademarks*